US006178784B1

(12) United States Patent
Marley, Jr.

(10) Patent No.: US 6,178,784 B1
(45) Date of Patent: Jan. 30, 2001

(54) KNIT CRISS-CROSS BRASSIERE, BLANK AND METHOD FOR MAKING SAME

(75) Inventor: Joel Wayne Marley, Jr., Morganton, NC (US)

(73) Assignee: Alba-Waldensian, Inc., Valdese, NC (US)

( * ) Notice: Under 35 U.S.C. 154(b), the term of this patent shall be extended for 0 days.

(21) Appl. No.: 09/316,831

(22) Filed: May 21, 1999

(51) Int. Cl.[7] ..... D04B 9/54; A41B 9/06
(52) U.S. Cl. ..... 66/173; 450/92; 66/176
(58) Field of Search ..... 66/169 R, 170, 66/171, 172 R, 173, 175, 176, 177; 450/86, 92, 70; 2/76, 73

(56) References Cited

U.S. PATENT DOCUMENTS

| | | | | |
|---|---|---|---|---|
| 4,341,219 | | 7/1982 | Kuznetz . | |
| 4,372,322 | | 2/1983 | Stern et al. . | |
| 4,531,525 | | 7/1985 | Richards . | |
| 4,624,115 | | 11/1986 | Safrit et al. . | |
| 4,816,005 | | 3/1989 | Braaten . | |
| 5,081,854 | | 1/1992 | Lonati . | |
| 5,479,791 | | 1/1996 | Osborne . | |
| 5,553,468 | | 9/1996 | Osborne . | |
| 5,592,836 | * | 1/1997 | Schuster et al. | 66/176 |
| 5,605,060 | | 2/1997 | Osborne . | |
| 5,746,068 | | 5/1998 | Popa et al. . | |
| 5,850,745 | | 12/1998 | Albright . | |
| 5,946,944 | * | 9/1999 | Osborne | 66/176 |
| 6,082,145 | * | 7/2000 | Lonati et al. | 66/176 |

FOREIGN PATENT DOCUMENTS 2220150 9/1974 (FR) .

* cited by examiner

*Primary Examiner*—Danny Worrell
(74) *Attorney, Agent, or Firm*—Alston & Bird LLP

(57) ABSTRACT

A brassiere having a minimal number of seams and allowing for independent breast support is described. The brassiere is produced from a circularly knit blank having a first tubular portion, and integrally knit cylindrical tubular welt portion, and an integrally knit second tubular portion. Portions of each of the first and second tubular portions are cut and removed to define right and left front portions, and the remaining portion of one of the first or second tubular portions is inverted so that the remaining parts of each of the first and second tubular portions extend away from the welt portion in generally the same direction. Banding can be attached to form neck and arm openings, and, where applicable, the front and rear strap portions can be secured together, thereby forming a finished brassiere. In this way, substantially seamless brassieres having right and left breast covering portions made to have visually distinct appearances can be readily and easily produced.

15 Claims, 2 Drawing Sheets

KNIT CRISS-CROSS BRASSIERE, BLANK AND METHOD FOR MAKING SAME

FIELD OF THE INVENTION

The invention generally relates to a substantially seamless brassiere, and a blank and method for making the brassiere. More specifically, the invention relates to a substantially seamless criss-cross brassiere which can be readily and easily manufactured, to have a variety of visual appearances.

BACKGROUND OF THE INVENTION

Brassieres are generally designed to be close-fitting, and can represent a source of significant discomfort to the wearer. For example, in addition to being constrictive, the seams and narrow straps often forming a part of the brassieres can tend to press uncomfortably into the wearer's flesh, particularly after they have been worn for a length of time or when the wearer has been physically active.

Because societal norms generally require that such garments should be worn, and many women must rely on them to provide a degree of support and coverage, the discomfort associated with them is typically viewed as something which must simply be tolerated. Furthermore, because the production of brassieres is generally a labor intensive process, their manufacturing costs can be relatively high. Therefore, manufacturers have attempted to find ways for simplifying the production of brassieres in order to reduce the costs associated therewith, in addition to looking for ways to improve wearer comfort.

For example, commonly-assigned U.S. Pat. Nos. 5,479,791 and 5,553,468 to Osborne, the subject matter of which is incorporated herein by reference, describe circularly knit brassieres which, in addition to being capable of simplified manufacture, also provide enhanced wearer comfort. To this end, the brassieres described in the Osborne patents are each produced from a substantially seamless circularly knit tubular blank having a turned welt at one end thereof, with portions of the tubular portion of the blank being removed to define neck and arm openings, and the front and back sections of the tubular portions of the blank being sewn together at the shoulders. Banding is then provided at the neck and arm openings to form a finished brassiere.

Another brassiere is described in U.S. Pat. No. 4,531,525 to Richards. The Richards patent describes a brassiere blank made on a circular knitting machine and having a torso portion with a pair of breast cups and straps knit integrally with the torso portion and having turned welt portions at each end of the cylindrical blank. The tubular blank is slit on one side, laid flat for cutting neck and arm openings, and seamed at each side to form a brassiere. The brassieres described in this patent therefore have side seams which can tend to cause discomfort to the wearer.

SUMMARY OF THE INVENTION

The instant invention provides a brassiere which has only a minimal number of seams, and which can be readily and easily manufactured. In addition, the instant invention enables the individual support of each of the breasts of the wearer, thereby providing unique comfort and support. Furthermore, the instant invention enables the provision of unique visual and aesthetic properties to the brassieres.

Initially, it is to be noted that while the garment is referred throughout this application as being a "brassiere", this term is meant in a broad sense to thereby encompass any type of relatively close-fitting upper torso covering garment. For example, the brassiere can be worn under other items of clothing in the form of an undergarment, as a camisole, athletic top, bathing suit top, dancewear, shirt, halter top, or the like.

The instant invention desirably has a crisscross construction, and is capable of being produced without side seams (which might bear uncomfortably on the wearer). In fact, in one aspect of the invention, the brassiere has two shoulder straps (one for covering each of the respective shoulders of the wearer), and only a single seam is provided along each of the shoulder straps, thereby resulting in a substantially seamless brassiere. As will be discussed more fully below, the seams can be provided to correspond to the tops of the wearer's shoulders, or they can be offset from the tops of the wearer's shoulders (such as by making the front strap portions longer than the rear strap portions or vice versa), so that when the ends of the strap portions are joined together, the seams are offset from the tops of the wearer's shoulders and positioned forwardly or rearwardly thereof.

The substantially seamless brassiere is achieved by way of the blank being circularly knit in a substantially continuous manner to include a first series of knit courses defining a first tubular portion, a second series of courses integrally knit with the first series of courses and forming a cylindrical tubular portion (e.g., in the form of a turned welt), and a third series of courses defining a second tubular portion knit to the second series of courses. The resulting blank is in the form of an elongate, generally continuous tubular structure having a cylindrical welt extending outwardly from a central portion of the tube to thereby encircle the tubular structure.

Portions of each of the first tubular portion and the second tubular portion are then removed to define right and left body covering portions, and one of the right and left body covering portions is inverted so that each of the right and left body covering portions extends from the cylindrical welt in generally the same direction. In order to minimize material waste in these portions which are to be removed during transformation of the blank into a brassiere, the portions designed to be removed are, in some aspects of the invention, formed so as to require less material input. For example, the stitches in these areas can be lengthened to produce a meshy fabric in the areas which will become waste, a less expensive yarn could be used to knit those areas, etc.

Edges of the right and left body portions are finished, to thereby form a brassiere. As mentioned above, in one form of the invention, the right and left body covering portions include both front and rear portions, with these front and rear portions being secured together to form shoulder straps for the brassiere. In another aspect of the invention, the right and left body covering portions could include front covering portions which are adapted to cover both of the wearer's breasts, and which are adapted to be secured together to form a generally halter-shaped structure. Also, it is to be noted that the steps of inverting and finishing of the edges of the right and left body covering portions can be performed in any order found to be efficient by the manufacturer, within the scope of the instant invention.

The blank can also include regions which are knit differently from other regions, to form discrete regions with more or less stretch than other of the regions of the respective blank portion, to provide select regions of more or less support. Furthermore, the first tubular portion can be knit so as to be visually distinct from the second tubular portion, for example, by using yarns of different colors in each of the regions, knitting in a visual pattern in one of the tubular portions, varying the knit stitch pattern or the like, etc., such that one breast cup of the brassiere has a different visual appearance from the other breast cup. Also, plating of the yarns could be used to provide different visual characteristics to each of the respective first and second tubular portions, whereby brassieres can be produced having different visual characteristics on each of the right and left sides. For example, one tubular portion could be knit to have stripes, while the other is knit as a solid color, to thereby produce a brassiere having a striped first breast covering side and a solid second breast covering side. As a further alternative, a spandex yarn could be plated while knitting the first and second tubular portions, such that when one of the portions is inverted to form the finished brassiere, one side has a shimmery effect due to the spandex appearing on the outer fabric surface of that side of the brassiere. As illustrated, because of the construction and manufacturing process forming a part of the instant invention, the provision of unique aesthetic appearances is enabled, while also providing a brassiere having the comfort of a generally seamless brassiere.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
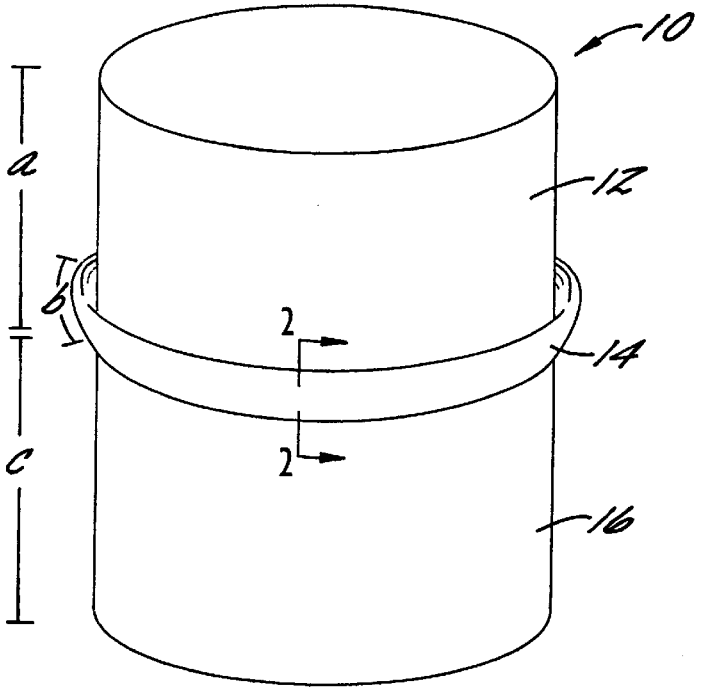
FIG. 1 is a perspective view of a blank made according to the instant invention.

With reference to the drawings, FIG. 1 illustrates a blank, shown generally at 10, formed according to the instant invention. The blank 10 is desirably circularly knit to include a first tubular portion 12 having a first length a. A tubular, cylindrical welt 14 is integrally knit to the first tubular portion 12 so that it extends outwardly from the first tubular portion a distance b. In a preferred form of the invention, the tubular, cylindrical welt 14 will be in the form of a turned welt, such terminology being known to those having ordinary skill in the art. Such welts are generally formed by holding a set up course, drawing the fabric away until a sufficient length has been knit to form the double-thickness welt, then transferring the held course back onto the needles so that it is knit into the structure.

A second tubular portion 16 is integrally knit to the tubular, cylindrical welt 14. This second tubular portion 16 has a second length c. In many embodiments of the invention, this length c of the second tubular portion 16 will be approximately equal to the length a of the first tubular portion 12.

Each of the tubular portions 12, 16 and the tubular cylindrical portion 14 desirably has a circumference which is sized to correspond with the size of the wearer who is expected to wear a brassiere made from the particular blank. In other words, the tubular circumference of the blank will generally be on the order of the same size as the circumference of a torso of a wearer for whom a brassiere is designed to fit, or somewhat smaller than the intended wearer's torso such that when the knit fabric gives through its natural extensibility, it provides a close fit about the wearer. For example, some extensibility may be provided through the particular knit stitch construction used, while stretch may also be provided by way of the incorporation of stretch yarns in the fabric, in addition to or instead of the stretch provided through the knit structure itself. Furthermore, it is noted that the amount of stretch can be varied at discrete points throughout the dimension of the tubular portions 12, 16 and the cylindrical tubular portion 14, for either aesthetic purposes or to vary the physical characteristics thereof. For example, it may be desirable to knit-in regions of less stretch to provide supplemental support regions on the finished brassiere, etc.

Figure 2:
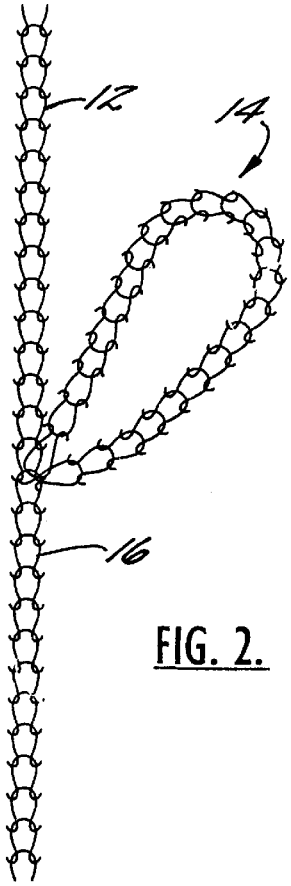
FIG. 2 is a cross-sectional view taken along the line 2—2 of FIG. 1, illustrating the manner in which the welt is secured to the first and second tubular portions.

As illustrated more clearly in FIG. 2, which is a cross-section taken along lines 2—2 of FIG. 1, the cylindrical welt 14 extends outwardly from the first and second tubular portions 12, 16, thereby defining a length b (with the actual length of fabric forming the welt being about two times length b). It is noted that the knit stitches illustrated have been simplified for purposes of clearly illustrating that the tubular, cylindrical welt 14 is formed by way of knit stitches and integrally formed with the first and second tubular portions 12, 16 by way of the knitting process. Other knit fabric and stitch structures can be utilized within the scope of the instant invention. In fact, it is desirable that this tubular, cylindrical welt portion 14 is fashioned so as to be more resistant to stretch than the tubular portions 12, 16, since the welt portion 14 will form the lower band portion of the finished brassiere once it is fashioned from the blank 10. The resistance to stretch can be done through alteration of the knit stitch construction, the feeding or floating in of additional stretch yarn(s) such as those made from spandex, natural rubber, or the like, or other methods conventionally known in the art for varying the stretch of knit fabrics.

As noted above, the first tubular portion 12 and second tubular portion 16 desirably have lengths a and c which are substantially equal to each other in length. In this way, when a brassiere is cut from the blank 10, it is relatively easy to ensure that the right and left portions of the brassiere are similarly sized, and that waste is minimized.

Figure 3:
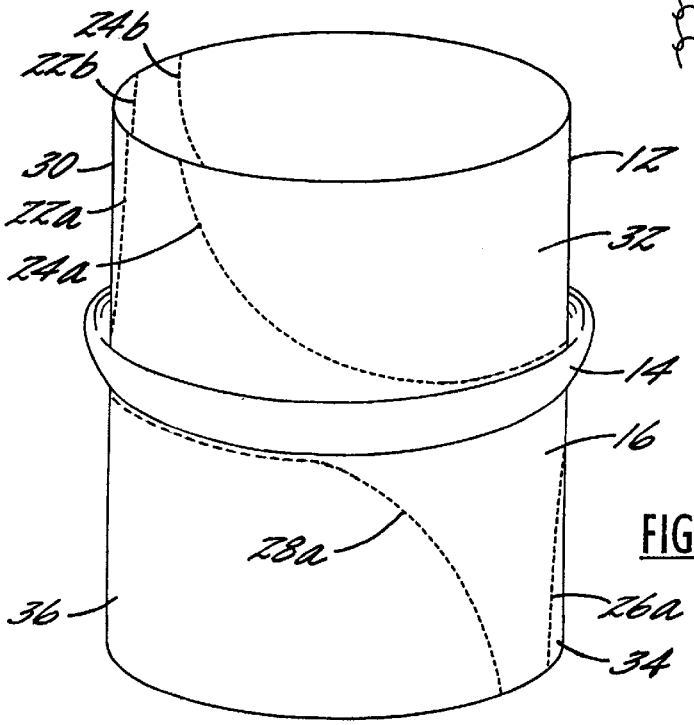
FIG. 3 is a perspective view of the blank shown in FIG. 1, illustrating the lines along which the blank can be cut to form one embodiment of the invention.

As illustrated in FIG. 3, the tubular blank is desirably cut along lines 22*a*, 22*b*, 24*a*, 24*b* along first tubular portion 12 with portions 30, 32 being removed as waste. Similarly, second tubular portion 16 of the blank 10 is cut along lines 26*a*, 28*a*, and in corresponding mirror image on the rear side of the tubular blank in the same manner as with the first tubular portion 12. Following cutting, pieces 34, 36 of the second tubular portion 16 are removed as waste.

The cut edges formed at 22*a* and 22*b* will form one arm opening on one side of a finished brassiere, while the cut edges formed at 24*a* and 24*b* will form a portion of a neck opening on the finished brassiere. Likewise, the cut edge formed at 26*a* and its corresponding edge on the rear side of the blank will form a second arm opening in the finished blank, while the cut edge formed at 28*a* and the corresponding one on the rear of the blank will define a portion of a neck opening of the brassiere.

Figure 4:
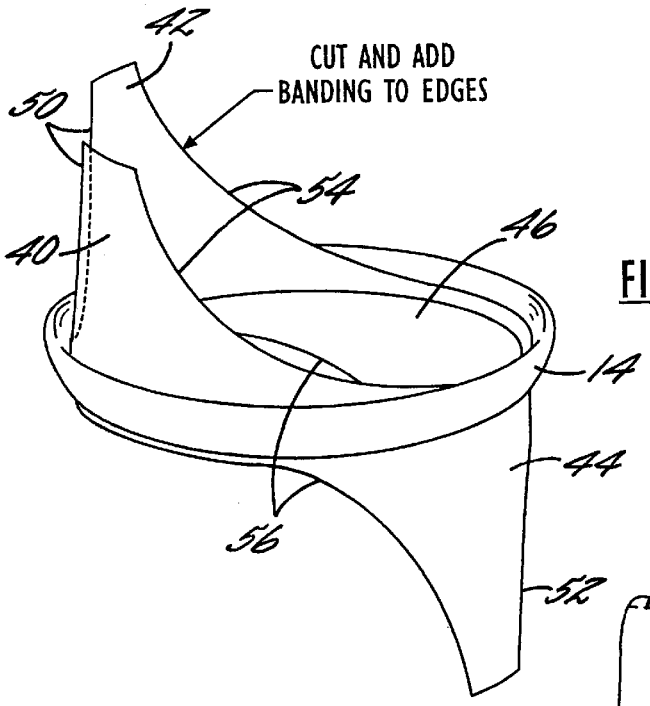
FIG. 4 is a perspective view of the blank shown in FIG. 3 after it has been cut along the lines shown in FIG. 3, and showing where banding can be added to finish the edges.

As shown more clearly in FIG. 4, the remaining portions of the blank can then be finished to form a completed brassiere. In particular, the blank now defines a front right strap portion 40 and a rear right strap portion 42 formed from first tubular portion 12 while corresponding left front strap portion 44 and left rear strap portion 46 are formed from second tubular portion 16. It is noted that in order to minimize waste, the portions 30, 32, 34, 36 which are designed to be removed during the transformation of the blank into a brassiere, can be formed so as to include less yarn than the portions of the blank which will remain to form portions of the brassiere. For example, methods such as lengthening the stitches, using different-sized or less expensive yarns to form these waste portions, or the like (e.g. lessening the waste material in a manner like that described in the aforementioned U.S. Pat. Nos. 5,479,791 and 5,553,468) will desirably be utilized.

The front and rear right strap portions 40, 42 are then sewn or otherwise secured together, as shown at 66, for example, so as to form a shoulder strap 60. Likewise, the left front and rear strap portions 44, 46 are sewn together to form a left shoulder strap 62. In the illustrated embodiment, the front and rear right strap portions 40, 42, and likewise the front and rear left strap portions 44, 46 are illustrated as being substantially the same size. Therefore, when the ends of the strap forming portions remote from the cylindrical welt 14 are sewn together, it results that the seam 66 formed by the securement of the straps together is positioned generally on top of a wearer's shoulder in the finished article. However, it is noted that the strap forming portions could be secured together at other portions such that the seam is offset from the top portion of the wearer's shoulder. Furthermore, they can be secured together in a releasable fashion as opposed to a more permanent fashion such as sewing. However, in the preferred embodiment of the invention, the front and rear right strap forming portions are sewn together at their respective strap forming portion ends and the left strap forming portions are sewn together in like manner.

The cut edges of the blank are then finished, preferably by sewing elastic banding to each of the cut regions, i.e., along cut region 50 (formed by cutting along lines 22*a* and 22*b*) to form a right arm hole 68 and along line 52 (formed by cutting along lines 26*a* and the corresponding line on the rear of the blank) to form a left arm hole 69 and along line 54 (formed by cutting along lines 24*a* and 24*b*) to form the edge of the right strap portion and a portion of neck opening 72, and along line 56 (formed by cutting along line 28*a* and the corresponding line on the rear of the blank) to form the edge of the left strap portion and a portion of neck opening 72. It is to be noted that the order in which the finishing steps are performed is a matter of manufacturing choice: for example, the strap forming portions can be secured together, then the banding added, or the banding can be secured to the cut edges first, and then the strap-forming portions secured together. Furthermore, the inverting step (discussed more specifically below) can be performed at any point during the process, the order being determined according to which achieves the most optimal manufacturing efficiencies for the particular manufacturer.

Figure 5:
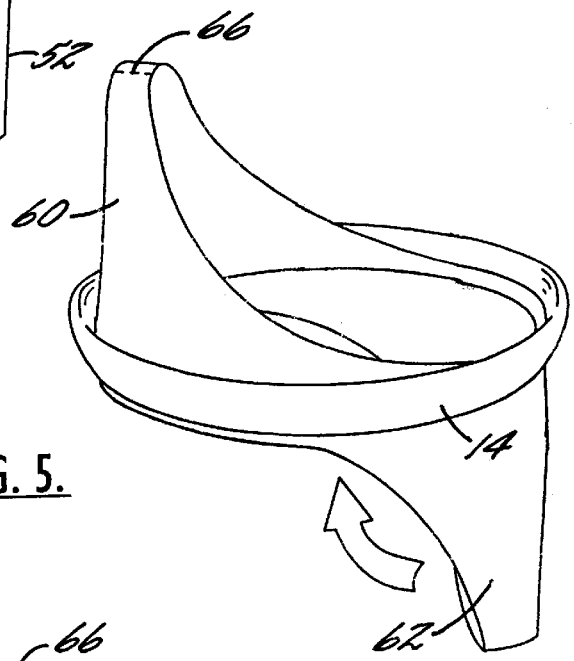
FIG. 5 is a perspective view illustrating how the blank shown in FIG. 4 can be inverted and the front and rear portions seamed together.
Figure 6:
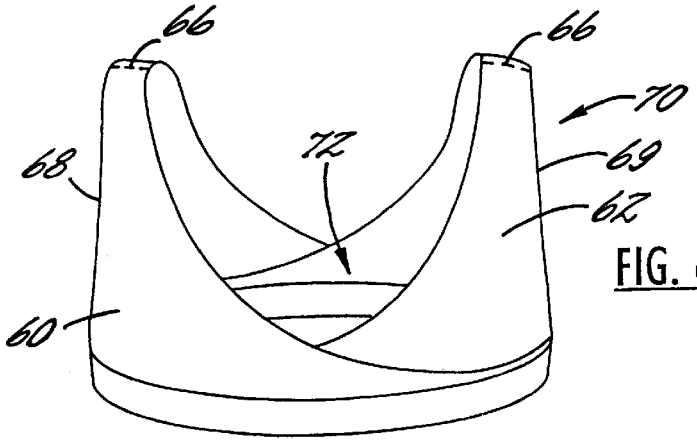
FIG. 6 is a perspective view of a finished brassiere according to the invention.

One of the strap forming portions is inverted so that both straps extend upward from the turned welt 14 in the same direction in the manner shown in FIGS. 5 and 6. For example, in FIGS. 5, the left strap portion 62 is shown being inserted through the center of the tubular cylindrical welt 14 so that the right and left strap forming portions 60, 62, respectively are extending away from the tubular cylindrical welt in the same direction.

The finished brassiere 70 provides individual breast support for the wearer, and is readily and easily manufactured. Furthermore, as illustrated in FIG. 6, because of the criss-cross construction, in some embodiments of the invention the left portion of the brassiere can be shaped so that it crosses to provide under-breast support for the wearer's right breast, and the right portion of the brassiere can be likewise shaped so that it crosses to provide under-breast support for the wearer's left breast.

In the shoulder strap version of the invention, the brassiere 70 desirably includes a right strap 60, a left strap 62, a right arm opening 68, a left arm opening 69, and a neck opening 72. Alternatively, the right and left front portions could be tied or otherwise operatively secured together to form a halter-shaped brassiere.

In one aspect of the invention, the first tubular portion 12 and second tubular portion 16 are formed from different colored yarns. In this way, when the finished brassiere is completed, one of the strap portions and breast cups has a first visual appearance while the other has a second distinct visual appearance. For example, yarns can be plated (e.g. with spandex appearing on one fabric surface) so that when one portion of the blank is inverted, the resulting garment has one side with a visually distinct appearance from the other (e.g. the spandex provides a more shimmery appearance.) Similarly, one side (e.g. the right side) can be knit to have polka dots or stripes, while the other side (e.g. the left side) is knit from a solid color. As will be appreciated by those of ordinary skill in the art, various other combinations of visual colors, patterns, etc. can be used within the scope of the instant invention. As a result, a virtually limitless range of visual appearances can readily and easily be provided to the brassiere.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A method of making a circularly knit brassiere blank comprising the steps of:

knitting a first series of courses defining a first tubular portion;

knitting to said first series of courses a second series of courses defining a cylindrical tubular welt;

knitting to said first series of courses a third series of courses defining a second tubular portion, to thereby define a blank in the form of a generally continuous tube with a cylindrical welt extending outwardly from a central portion thereof.

2. A method of making a circularly knit brassiere blank according to claim 1, wherein said step of knitting a second series of courses comprises knitting a turned welt which is relatively more resistant to stretch than said first and second tubular portions.

3. A method of making a circularly knit brassiere blank according to claim 1, wherein said first tubular portion is substantially the same length as said second tubular portion.

4. A method of making a circularly knit brassiere blank according to claim 1, wherein said steps of knitting said first and third series of courses comprise reducing the amount of yarn input in certain regions of each of said first and second tubular portions, to thereby minimize waste when the blank is converted into a brassiere.

5. A substantially seamless knit brassiere comprising:

a generally ring-shaped band for encircling the upper torso of a wearer, said band having front and rear sides;

a first body member secured to substantially the entire circumference of said band and extending outwardly therefrom in the form of a first loop-shaped strap and a second body member secured to substantially the entire circumference of said band and extending outwardly therefrom in the form of a second loop-shaped strap, wherein each of said first and second body members is integrally knit with said generally ring-shaped band, and each of said first and second body members defines a breast-covering portion and a shoulder portion.

6. A substantially seamless knit brassiere according to claim 5, wherein said brassiere includes seams only on the shoulder portion thereof.

7. A substantially seamless knit brassiere according to claim 5, wherein one of said first and second body members crosses over the other of said first and second body members.

8. A substantially seamless knit brassiere according to claim 5, wherein said first body member is formed from a first knit fabric and said second body member is formed from a knit fabric having a visually distinct appearance from said first fabric.

9. A method of making a circularly knit brassiere comprising the steps of:

knitting a first series of courses defining a first tubular portion;

knitting to said first series of courses a second series of courses defining a cylindrical tubular welt;

knitting to said second series of courses a third series of courses defining a second tubular portion;

cutting and removing portions of said first tubular portion to define front and rear first strap portions therefrom and from said second tubular portion to define front and rear second strap portions therefrom;

securing the front and rear first strap portions together to define a first shoulder strap and second strap portions together to define a second shoulder strap; and inverting one of said shoulder straps such that said first and second shoulder straps extend from said cylindrical tubular welt in substantially the same direction.

10. A method of making a circularly knit brassiere according to claim 9, further comprising the step of securing banding to cut edges formed from said cutting and removing step, to thereby form finished edges.

11. A method of making a brassiere comprising the steps of:

circularly knitting a substantially continuous tubular blank having a first tubular section, a second tubular section, and a cylindrical welt extending outwardly from a central portion of said tubular blank at a position between said first and second tubular blanks;

cutting and removing portions of each of said first and second tubular sections to thereby define right and left body covering portions;

inverting one of said right and left body covering portions such that each of said right and left body covering portions extends from said cylindrical welt in generally the same direction; and finishing the edges of said right and left body covering portions, to thereby define a finished brassiere.

12. The method according to claim 11, wherein said step of finishing the edges of said right and left body covering portions comprises sewing elastic banding to edges formed by said cutting step.

13. The method according to claim 11, wherein said step of cutting and removing portions of each of said first and second tubular portions is performed to provide front and rear right body covering portions and front and rear left body covering portions.

14. The method according to claim 13, wherein said step of finishing the edges of said right and left body covering portions comprises securing said front and rear right body covering portions together and securing said front and rear left body covering portions together, to thereby form a pair of shoulder straps.

15. The method according to claim 14, wherein said step of finishing said right and left body covering portions further comprises securing elastic banding to edges formed by said cutting and removing step.

* * * * *